United States Patent [19]

Henggeler et al.

[11] 4,276,731

[45] Jul. 7, 1981

[54] SUPPORTING RIB ARRANGEMENT FOR A LOWER CEILING WHICH IS TO BE SUSPENDED BENEATH A STRUCTURE-FIXED CEILING AND METHOD OF USING SUCH SUPPORTING RIB ARRANGEMENT

[76] Inventors: Aldo Henggeler, Haldenstrasse 12, Luzern; Roland Crottaz, Seestrasse 89, Hergiswil, both of Switzerland

[21] Appl. No.: 726,306

[22] Filed: Sep. 24, 1976

Related U.S. Application Data

[63] Continuation-in-part of Ser. No. 520,729, Nov. 4, 1974, abandoned.

[30] Foreign Application Priority Data

Nov. 15, 1973 [CH] Switzerland ..... 16052/73

[51] Int. Cl.³ ..... E04B 5/52

[52] U.S. Cl. ..... 52/484; 52/665

[58] Field of Search ..... 52/484, 495, 488, 758 A, 52/486, 664, 665, 39

[56] References Cited

U.S. PATENT DOCUMENTS

| | | | |
|---|---|---|---|
| 2,920,357 | 1/1960 | Ericson | 52/484 X |
| 3,286,426 | 11/1966 | Halbostad et al. | 52/484 |
| 3,503,166 | 3/1970 | Nakazawa et al. | 52/484 |
| 3,590,544 | 7/1971 | Shepherd | 52/484 |

*Primary Examiner*—Carl D. Friedman

*Attorney, Agent, or Firm*—Werner W. Kleeman

[57] ABSTRACT

A supporting rib arrangement for a lower ceiling which is to be suspended beneath a structure-fixed ceiling and method of using such supporting rib arrangement comprising support or carrier profile members for supporting ceiling components of the lower ceiling, for instance precast slabs, said support profile members being arranged in a grid arrangement or field and abutting at their ends at node points. Suspension or hanging components are connected in such a manner with the supporting rib arrangement and the structure-fixed ceiling respectively, that they permit limited displacement of the supporting rib arrangement relative to the ceiling for tolerance compensation. The suspension components together with the support profile members are connected in spaced relationship from the node points and each individual suspension component is arranged to be adjustably movable in the three coordinate directions between the structure-fixed ceiling and the supporting rib arrangement independent of the remaining suspension components.

4 Claims, 6 Drawing Figures

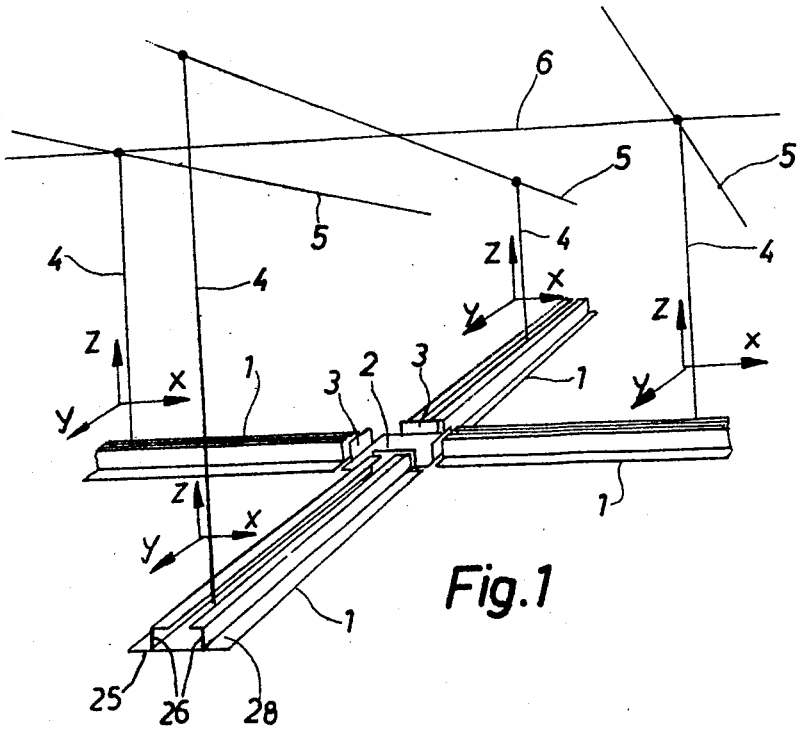
Fig.1
Fig.6
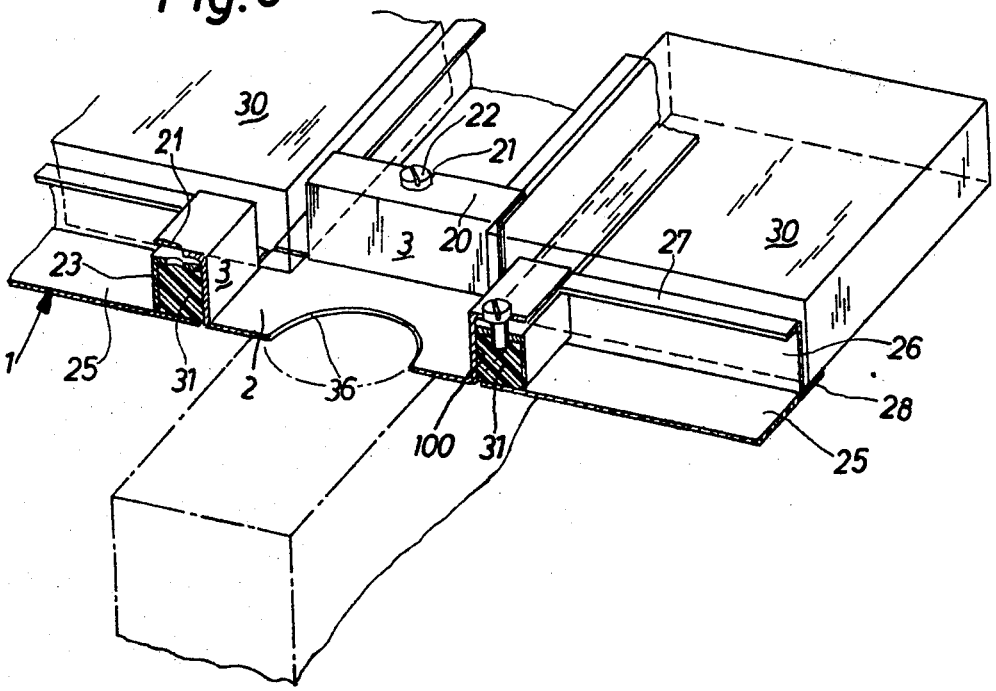

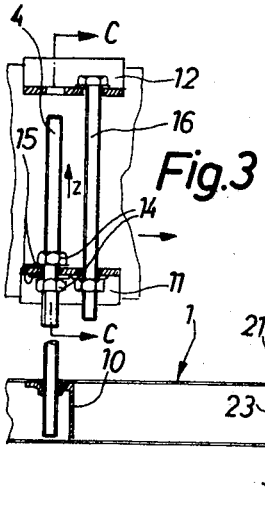
Fig.3
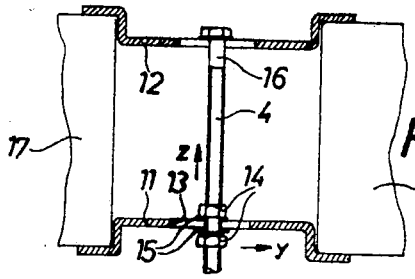
Fig.4
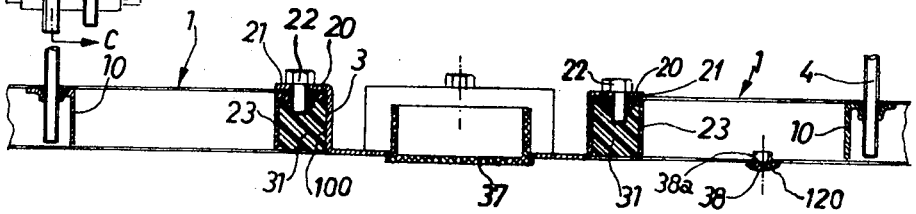
Fig. 2
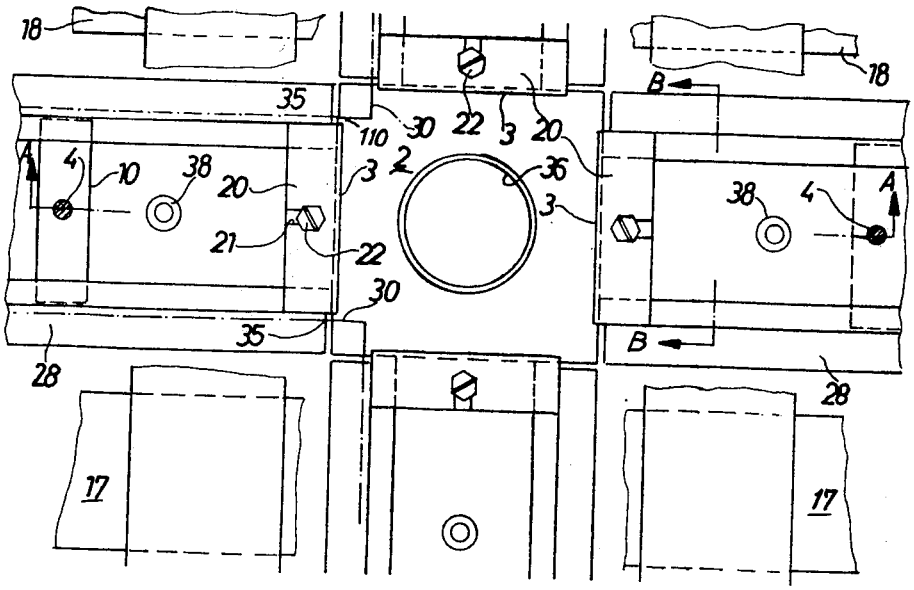
Fig.5
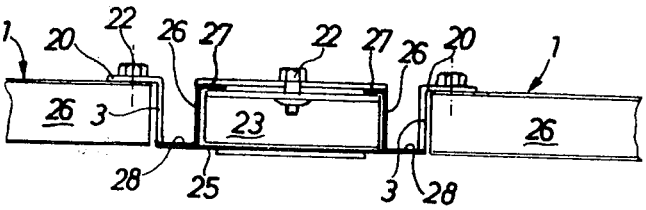

SUPPORTING RIB ARRANGEMENT FOR A LOWER CEILING WHICH IS TO BE SUSPENDED BENEATH A STRUCTURE-FIXED CEILING AND METHOD OF USING SUCH SUPPORTING RIB ARRANGEMENT

CROSS-REFERENCE TO RELATED CASE

This application is a continuation-in-part of my copending application Ser. No. 520,729, filed Nov. 4, 1974, now abandoned, and entitled "SUPPORTING RIB ARRANGEMENT FOR A LOWER CEILING WHICH IS TO BE SUSPENDED BENEATH A STRUCTURE-FIXED CEILING AND METHOD OF USING SUCH SUPPORTING RIB ARRANGEMENT".

BACKGROUND OF THE INVENTION

The present invention relates to a new and improved construction of supporting rib arrangement for a lower or under ceiling which is to be suspended at a structure-fixed ceiling wherein the support or carrier profile members supporting the ceiling components of the lower ceiling, for instance, precast slabs, are arranged in a grid arrangement or field and abut one another with their ends at node points. Further there are provided suspension or hanging components which are connected in such a manner with the supporting rib arrangement and the structure-fixed ceiling respectively, that they allow limited displacement of the supporting rib arrangement relative to the ceiling for tolerance compensation. The invention also relates to a method of using such supporting rib arrangement in a structure.

With a prior art supporting rib arrangement of this type, for instance as taught in Swiss Pat. No. 437,714, the suspension components in the form of vertical bolts are connected at fixed points of the structure-fixed ceiling and secured with the supporting rib arrangement at the node points. At these node points there are also undertaken measures to ensure that the bolts can be adjustably moved within narrow limits, and specifically through the aid of crosswise overlapping elongate holes in the connection plate and the support profile members and by means of an additional adjustment hole in the connection plate. An adjustment movement of a bolt, with this construction, is effective at all other connection locations with the other bolts at the node points. It is for this reason and because of the limited displacement possibility predicated upon such construction that it is impossible to compensate to a desired degree inaccuracies in the structure. This impairs the sound absorbing capability of the ceiling, because joints of different widths cannot be avoided at the support profile ends which directly abut one another at the miter cuts or bevel cuts. Furthermore, the aesthetic appearance of the ceilings which are suspended with the heretofore known support profile is unsatisfactory because the unavoidable inaccuracies are visible.

SUMMARY OF THE INVENTION

Hence, it is a primary object of the present invention to provide a new and improved construction of supporting or support rib arrangement of the initially mentioned type which is designed such that unavoidable inaccuracies in the structure can be completely compensated and rendered invisible.

A further object of the invention aims at a method of using the supporting rib arrangement of this development in a structure.

Now in order to implement these and still further objects of the invention, which will become more readily apparent as the description proceeds, the invention contemplates that the suspension components or parts are connected with the support or carrier profiles at a spacing from the node points, and each individual suspension component is arranged to be adjustably movable between the structure-fixed ceiling and the supporting rib arrangement in three coordinate directions independent of the remaining suspension components or parts.

Due to the direct connection of the suspension components which are adjustably movable independent of one another and with respect to the node points, there can be realized in an ideal manner a tolerance compensation. The node points are not influenced in any way whatsoever by the tolerance compensation, so that at the node points there can always be obtained without any problem the same satisfactory aesthetic appearance.

The adjustability of the suspension components can be attained both between the connection locations of the suspension components with the carrier or support profile members as well as also with the ceiling or as a combination of both of these possibilities. According to a preferred constructional embodiment of the invention it is, however, contemplated that the suspension components constructed as vertically aligned threaded bolts are threaded into the support profiles with an adjustable thread-in depth, and that they are connected with the ceiling to be adjustably movable in both main horizontal directions. This can be constructively realised in that each threaded bolt piercingly extends through an elongated hole in a bracket arrangement and is threadably connected therewith and which elongated hole is aligned in the one main horizontal direction, and which bracket arrangement is displaceably held at the ceiling in the other horizontal main direction.

The uncoupling of the adjustable mobility of the suspension of the supporting rib arrangement from the node points renders it possible to construct the node points completely independent of the tolerance compensation in consideration of optimum sound dampening and optimum aesthetic effect. To this end according to a further preferred construction of the invention it is contemplated that the ends of the carrier or support profiles with an elastic buffer as the sound absorbing material flushly abut at flexed arms of a connection plate arranged at the node point and in each instance are detachably connected with such arm. A practical construction of a node point is characterized by the features that the main plane of the connection plate and the support surfaces of the support profile for precast slabs or plates of the lower ceiling are located at the level of the underside of the lower ceiling and the arms of the connection plate which are bent up from the main plane form free intermediate spaces into which extend the precast slabs at their corners, so that apart from such slabs bearing upon the support or carrying surfaces of the support profiles they also bear upon partial regions or zones of the connection plate.

Further, the support profile members and equally the node points are visible in the as-mounted condition of the lower ceiling and provide free and unhindered access for the installation of various types of fixtures or the like at the node points as well as also at the support profile members. The system is constituted such that apart from the adjustability of each individual suspension component in the three coordinate directions between the structure-fixed ceiling and the support grid arrangement independent of the remaining suspension components, adjustment means allow for a further degree of adjustment of the support profile members in their lengthwise direction. Hence, between any two adjacent node points the support profile member extending therebetween is movable within a given tolerance range and the suspension components of the associated profile member enable movement of such profile member within such tolerance range at one node point without affecting the other node point, i.e., without requiring its readjustment. This beneficially enables the supporting rib arrangement to be further easily adjusted and accommodated to existing conditions, affording a great deal of flexibility and ease in assembly of the structure. Also, it is not necessary in all instances to have each of the support profile members provided with suspension components since, for instance, if at a node point two or three of the support profile members are supported by their suspension elements the remaining support profile member or members can simply bear at the node point and the load thereof carried by the other suspended support profile members. Finally, it is indicated that due to the deformability of the node point increased fireproofing for the building is attained since expansion of the support profile members in the event of a fire in the building can be taken up by the deformable node point.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a schematic illustration of the basic principle of the invention;

FIG. 2 is a plan view at the region of a node point and two connection locations between the carrier or support profile members of a supporting rib arrangement and the associated suspension components or parts;

FIG. 3 is a sectional view taken along the line A—A of FIG. 2;

FIG. 4 is a partial sectional view taken along the line C—C of FIG. 3;

FIG. 5 is a sectional view taken along the line B—B of FIG. 2; and

FIG. 6 is a perspective view through a node point cut along the line A—A of FIG. 2 of a supporting rib arrangement according to the invention.

DETAILED DESCRIPTION OF THE INVENTION

With the perspective principle illustration according to FIG. 1, reference numeral 1 designates four support or carrier profiles or profile members which are arranged essentially perpendicular to one another and which conjointly abut at their ends at a connection plate 2 or the like arranged at and defining a node point or location. The connection plate 2 has four upwardly flexed arms 3 which serve for the bearing or contact of the cross-sections of the support profiles or support profile members 1 or an intermediately interposed sound-absorbing buffer (not particularly shown in FIG. 1). These support profile members or profiles 1 have lateral support surfaces 28 which are arranged in a plane with the connection plate 2 and serve for taking up the edges of structural components, such as precast slabs 30 or the like (FIG. 6) which have not been particularly shown in FIG. 1 as a matter of convenience in illustration.

Each carrier or support profile member 1 is connected at a spacing from the node point defined by the connection plate 2 via a suspension or hanging component or part 4, for instance a threaded bolt, with the ceiling schematically indicated in FIG. 1 by the intersecting lines 5, 6. Each support or carrier profile member 1 is suspended through the agency of at least two suspension components or parts 4 at the ceiling, of which in FIG. 1 in each instance only one has been illustrated.

According to the basic principle of the invention the arrangement is undertaken such that each suspension component is adjustably movable parallel to itself in the three coordinate directions x, y, and z. The adjustable mobility can be realised in different ways. Thus, for instance, it can be obtained in each case at one of the connection points of the suspension component 4 with the support profile or the ceiling itself. The movement mobility in the different directions can be, however, also realised componentwise or incrementally at both connection locations of each suspension or hanging component.

FIG. 1 renders clear that the compensation of unavoidable inaccuracies in the structure can be undertaken remote from the node points at the supporting rib arrangement according to the invention, wherein each individual suspension part or component 4, independent of the other suspension or hanging parts, contributes a certain amount to this tolerance compensation. The node point can be constructed without hindrance by the necessary tolerance compensation in consideration of an optimum sound dampening and with regard to a satisfactory aesthetic appearance.

A practical construction according to the invention has been illustrated in FIGS. 2 to 6. In this regard it is to be understood that the same or functionally same components have been conveniently designated with the same reference characters as were used for the arrangement of FIG. 1. Apart from the constructional details it is also possible to recognize from these figures that the adjustable mobility at the connection locations of the suspension components constructed as threaded bolts 4 is shifted or set with respect to the ceiling. Initially there will be described the constructional details of the suspension of a supporting rib arrangement as such has been shown in FIGS. 3 and 4.

Eash threaded bolt 4, of which in the exemplary illustrated embodiment for each support or carrier profile member 1 there are associated therewith a total of two, is threaded into an angle rail 10 connected with i.e. preferably slideably arranged and held in the associated support or carrier profile 1. This displaceable angle rail 10 is partially also shown in plan view in FIG. 2 and provides an additional adjustment possibility for the support profiles in their lengthwise direction. Threaded bolt 4 is not directly secured to the structure-fixed ceiling, 5, 6 rather via a bracket arrangement incorporating a lower bracket 11 and an upper bracket 12. The threaded bolt 4 extends with its upper free end through an elongate hole 13 into the lower bracket 11 and is clamped at such elongate hole by means of the nut members 14 and the disks 15. The nut members 14 render possible a change in the spacing of the supporting or support rib arrangement from the ceiling, i.e. an adjustable mobility in the z-direction (FIG. 1), whereas the elongate hole 13 (FIG. 4) allows for an adjustable mobility in the y-direction. Both of the brackets 11, 12 are connected by means of a bolt 16 in order to form the bracket arrangement.

In order to also render possible an adjustable mobility of the threaded bolts 4 in the x-direction, the entire bracket arrangement 11, 12, 16 is displaceable in the lengthwise direction in relation to the ceiling beams 17, 18 of the structure-fixed ceiling 5, 6. Since the illustrated arrangement can be realized for each suspension bolt, compensation of even large tolerances is possible without any problem. Further, due to the described arrangement it should be appreciated that a support profile member 1 extending between two neighboring node points can move within a certain tolerance range and such support profile member can be moved within such tolerance range at one node point without affecting the other node point. Consequently, deviations in the spacing of two neighboring node points from a given value can be easily compensated by appropriately shifting the support profile member located therebetween and without the need to reposition one or the other of such node points. Equally the deformability of the connection plate 2 at the node point allows for expansion of the support profile member in the event of a fire, to thereby maximize at least prolong the time needed for destruction of the ceiling.

Hereinafter there will now be considered and described in detail the construction of the support profile members 1, the connection plate 2 and their connection, specifically in conjunction with FIGS. 2, 3, 5 and 6.

The square or quadratic constructed connection plate 2 has four arms 3 which are upwardly flexed from its sides, the upper ends 20 of which are flexed in a horizontal plane. At their central region the upper ends 20 have a slot 21 for receiving a screw 22 which is threadably connected with an angle member 23 fixedly connected with the end of the support profile 1. The cross-section of a support profile 1 can be best seen by referring to FIG. 6, wherein however there has been shown in perspective only one-half of such cross-section. Accordingly, the support or carrier profile 1 has a horizontal base 25 from which upwardly extend two angle legs 26. The angle legs 26 are arranged at a spacing at the base 25 corresponding to the length of the arms 3 of the connection plate 2 and in each case allow free external support surfaces 28 for the edges of precast slabs 30 or the like which have been shown in phantom lines in FIG. 2 and in full lines in FIG. 6. The support surfaces 28 are arranged at the same height as the surface of the connection plate 2.

The arms 3 with their flexed upper ends 20 and the angle members 23 form a hollow compartment or space 100 (FIGS. 3 and 6) of approximately square or quadratic cross-section, in which there is received a strip 31 of a flexible, sound-absorbing material. This strip 31 in each case bridges the joint between the abutment of the end face of an end of the support profile and the arm 3.

Since the arms 3 only extend over part of the edge length of a connection plate 2, these arms 3 leave free intermediate spaces 110. Into these intermediate spaces there extend the corners of the precast slabs or plates 30 or the like.

From the showing of FIG. 2 it will be apparent that propagation of the sound, with the described construction, is only possible via the surface squares 35 present owing to the unavoidable play.

All other joints are covered in a sound tight fashion. The surface squares 35, with the indicated construction, can have dimensions of 2×2 mm. They permit the passage of sound in only a practically negligible amount.

The visible joints which can be recognized in FIG. 2 between the connection plate 2 and the ends of the carrier or support profiles 1 always can be made the same size owing to the relative displacement possibility between the support profile members and the node points. In this way there is realized a visually satisfactory total impression of the sub-ceiling or lower ceiling when viewing the same from below, and the support profile members 1 and node points are visible and provide free access for mounting fixtures or otherwise carrying out desired operations.

In particular from the showing of FIGS. 2 and 6 it will be apparent that the connection plate 2 is centrally provided with a throughpassage hole 36. This hole 36 serves, if desired, for the reception of supply lines, such as electrical lines or heating coils, if an intermediate wall is introduced along a support profile in the space located below the lower ceiling and which has not been particularly shown. If the node point does not carry out any such function then it is covered by a stopper or plug 37 (FIG. 3).

The throughpassage holes 36 of the connection plates 2 furthermore can serve for the direction-free attachment of, for instance, lamps, current connection elements, sprinklers, smoke detector installations and their control-lamps at the connection plates.

At the lower side of the carrier or support profiles 1 there are further connected at location 38 also mounting holes 38*a* which can be sealed in an airtight fashion by removable plugs or stoppers 120.

These mounting holes 38*a* in their entirety form a hole grid and serve for the detachable connection of different installation elements, typically various building elements, without being bound to any direction, such as facades, partition walls, current rails, illuminating devices, smoke detector installations, control lamps and sprinklers at the support profiles. At that location where an attachment should occur the stopper or plug 120 is removed.

An advantage of the supporting rib arrangement resides in the fact that there can be mounted at the same, ceiling components, such as precast slabs or plates, which are built up of different layers and which serve as insulation against sound, fire and heat in such a manner that the precast slabs or plates together with the supporting rib arrangement form an essentially horizontal insulation closure or barrier against sound, fire, and heat. In this connection there is formed a continuously hollow space between the lower ceiling, consisting of the supporting rib arrangement and the precast plates and the structure-fixed ceiling, and which hollow space for instance can serve for the reception of building or installation elements and installation lines or conduits.

The optically satisfactory total impression of the lower ceiling is further supplemented by the fact that the lower boundary of the lower ceiling, which is composed of components of the precast slabs or plates, the connection plates and the support profiles, form an essentially horizontal closure or barrier surface.

While there are shown and described present preferred embodiments of the invention, it is to be distinctly understood that the invention is not limited thereto, but may be otherwise variously embodied and practiced within the scope of the following claims. Accordingly,

What is claimed is:

1. A support rib arrangement for a lower ceiling which is to be suspended beneath a structure-fixed ceiling, comprising support profile members for supporting ceiling components of the lower ceiling, said support profile members being arranged in a grid arrangement with oppositely situated support profile members confronting one another at their ends at node points, suspension components which are connected in such a manner with the support rib arrangement and the structure-fixed ceiling respectively, that they render possible limited displacement of the support rib arrangement relative to the structure-fixed ceiling for tolerance compensation, said suspension components being connected with at least given ones of the support profile members at a spacing from the node points, and means for permitting each individual suspension component to be arranged to be adjustably movable between the structure-fixed ceiling and the support rib arrangement in three coordinate directions independently of the remaining suspension components, means for providing an additional adjustment possibility for the support profile members for selectively adjusting the position thereof in their lengthwise extending direction, each support profile member being movable between two neighboring node points through a predetermined tolerance range, said adjustably movable means for said suspension components and said additional adjustment means enabling each said support profile member to be adjustably movable within said tolerance range at one node point without affecting the other neighboring node point, said additional adjustment means including an angle rail connected to each of said suspension components, said support profile members having confronting angle legs forming lengthwise slots in said profile members for slidably receiving said angle rail.

2. A support rib arrangement for a lower ceiling which is to be suspended beneath a structure-fixed ceiling comprising support profile members for supporting ceiling components of the lower ceiling, such as precast slabs, said support profile members being arranged in a grid arrangement and abutting at their ends at means defining node points, suspension components which are connected in such a manner with the support rib arrangement and the structure-fixed ceiling respectively, that they render possible limited displacement of the support rib arrangement relative to the structure-fixed ceiling for tolerance compensation, the improvement comprising the suspension components being connected with the support profile members at a spacing from the node points, and means for permitting each individual suspension component to be arranged to be adjustably movable between the structure-fixed ceiling and the support rib arrangement in three coordinate directions independent of the remaining suspension components, said means defining said node points including a respective connection plate arranged at each node point, said connection plate having flexed arms, said support profile members having ends which abut by means of an elastic buffer formed of a sound-absorbing material flushly at said flexed arms of the connection plate arranged at a node point and are detachably connected with said arms.

3. The support rib arrangement as defined in claim 2, wherein each connection plate has a main plane, each support profile member possessing supporting surfaces, said supporting surfaces of the support profile members serving for the support of precast slabs of the lower ceiling and said supporting surfaces being located at the level of the underside of the lower ceiling, and said arms of the connection plate are flexed up from the main plane and leave free therebetween intermediate spaces into which piercingly extend the precast slabs with their corners so that apart from bearing upon the supporting surfaces of the support profile members they also bear upon partial regions of the connection plate.

4. The support rib arrangement as defined in claim 2, wherein the supporting surfaces comprise parts of a lower continuous horizontal base of the support profile members.

* * * * *